US005213036A

United States Patent [19]

Tokuno et al.

[11] Patent Number: 5,213,036

[45] Date of Patent: May 25, 1993

[54] SHEET FEEDING APPARATUS

[75] Inventors: Masateru Tokuno, Tokyo; Tatsuyuki Miyagawa, Yokohama, both of Japan

[73] Assignees: SK Engineering Ltd.; Reliance Electric Ltd., Kanagawa, Japan

[21] Appl. No.: 777,344

[22] PCT Filed: Apr. 12, 1991

[86] PCT No.: PCT/JP91/00480

§ 371 Date: Dec. 5, 1991

§ 102(e) Date: Dec. 5, 1991

[87] PCT Pub. No.: WO91/16254

PCT Pub. Date: Oct. 31, 1991

[30] Foreign Application Priority Data

Apr. 13, 1990 [JP] Japan ..... 2-96229

[51] Int. Cl.[5] ..... B65H 31/12; B65H 5/02

[52] U.S. Cl. ..... 101/232

[58] Field of Search ..... 101/232, 233, 234, 235, 101/236; 271/11, 12, 10, 90, 91, 94, 99, 35, 265, 270, 197

[56] References Cited

U.S. PATENT DOCUMENTS 4,232,859 11/1980 Tokuno ..... 271/10

4,541,624 9/1985 Sasage et al. ..... 271/12

4,774,446 9/1988 Salazar et al. ..... 101/233

*Primary Examiner*—J. Reed Fisher

*Attorney, Agent, or Firm*—McGlew & Tuttle

[57] ABSTRACT

With a sheet feeding apparatus, to feed sheets piled up in a hopper, piece by piece, to a printing press from a suction conveyor installed at bottom of the hopper, having motor for driving the suction conveyor, sensor positioned above the suction conveyor to detect front edges of sheets, and a control unit to equalize speed of motor with speed of plate cylinder of the said printing press and to adjust phase of sheet to phase of the plate cylinder, sheet feeding accuracy is improved.

2 Claims, 5 Drawing Sheets 1
2
3b
4b
6b
7
8
9
12
13b
15b
16b
17b
11b
14b
20b
21
22
23
L1
L2
M
PG
AMP
F/V
D/A
VAb
VCb
SPEED COMMAND
XX
YY
ZZ
W
B
Pulse Train Generator
Position Error Register
COUNTER
LATCH CLEAR
LOGIC CIRCUIT
FROM 6A
FROM 6B

SHEET FEEDING APPARATUS

TECHNICAL FIELD

This invention relates to a sheet feeding apparatus to feed sheets of corrugated cardboard and the like piled up in a hopper to a printing press piece by piece.

BACKGROUND TECHNOLOGIES

Conventional sheet feeding apparatus have, at bottom of a hopper, a kicker moving back and forth to push out the lowest bottom sheet in the hopper, or an apparatus having a suction conveyor and controlling only conveyor speed with motor.

A sheet feeding apparatus of the type having a kicker has such disadvantages that sheets are damaged at their surfaces contacting with the kicker in case of sheets of lower stiffness and that sheets are not always timely fed to the printing press. A sheet feeding apparatus of the type having a suction conveyor and controlling only conveyor speed with a motor has such a disadvantage that the accuracy to feed a sheet to the printing press is poor due to the untimely suction of sheets.

DISCLOSURE OF THE INVENTION

It is an object of this invention to provide a sheet feeding apparatus enabling the elimination of the said disadvantages of conventional apparatuses and to feed sheets without vacancies of shoot feeding and without damage to sheets.

Another object of this invention is to provide a sheet feeding apparatus enabling the improvement of sheet feeding accuracy by correction of mechanical error caused by suction of sheets by the conveyor.

A further object of this invention is to provide a sheet feeding apparatus enabling the correction of parallel error against a plate cylinder.

The sheet feeding apparatus of the first invention for feeding sheets piled up in a hopper, piece by piece, to a printing press from a suction conveyor installed at bottom of the hopper, comprising, a motor for driving the suction conveyor, a sensor positioned above the suction conveyor for detecting front edges of sheets being transferred, and a control unit for equalizing speed of the motor with speed of a plate cylinder of printing press and for adjusting phase of the sheet to phase of a press plate on the plate cylinder with a detection signal of the sensor, whereby sheet feeding accuracy is improved by correction of mechanical errors at suction of sheets.

The sheets feeding apparatus of the second invention for feeding sheets piled up in a hopper, piece by piece, to a printing press from first and second suction conveyors installed in parallel at bottom of the hopper, comprising, a first motor for driving the first suction conveyor, a second motor for driving the second suction conveyor, a first sensor positioned above the first suction conveyor for detecting front edges of sheets being transferred, a second sensor positioned above the second suction conveyor for detecting front edges of sheets being transferred, a first control unit for equalizing speed of the first motor with speed of a plate cylinder of printing press and for adjusting phase of the sheet to phase of a press plate on the plate cylinder with a detection signal of the first sensor, and a second control unit for equalizing speed of the second motor with speed of the plate cylinder of printing press for adjusting phase of the sheet to phase of the press plate with the detection signal of the first sensor, and for correcting parallel error of the sheet against the press plate with detection signals of the first and second sensors, whereby sheet feeding accuracy is improved by correction of mechanical error and parallel error at suction of sheets.

BEST MODE FOR EXECUTING THE INVENTION

Figure 1:
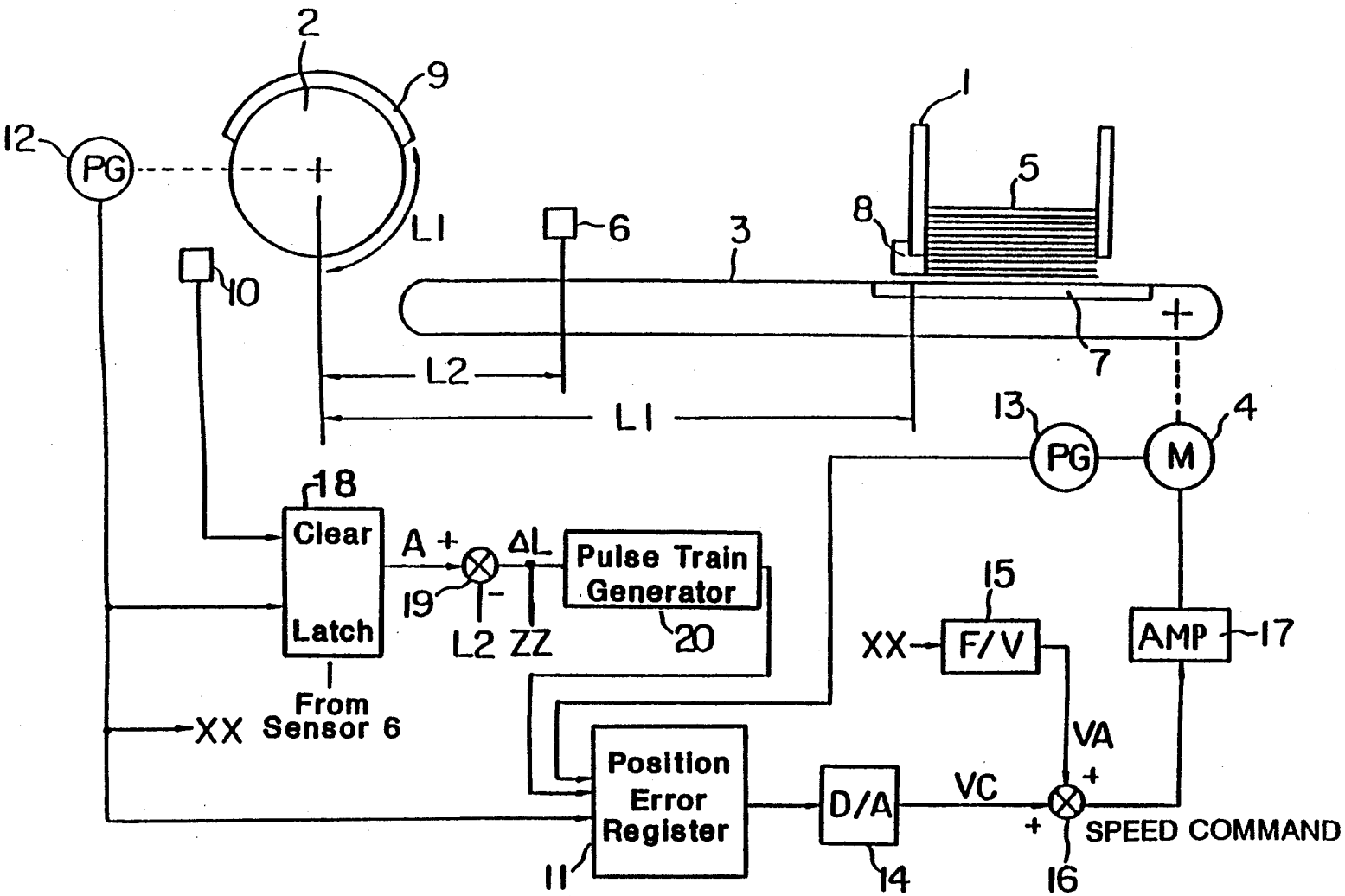
FIG. 1 shows the construction of an embodiment of the first invention.
Figure 2:
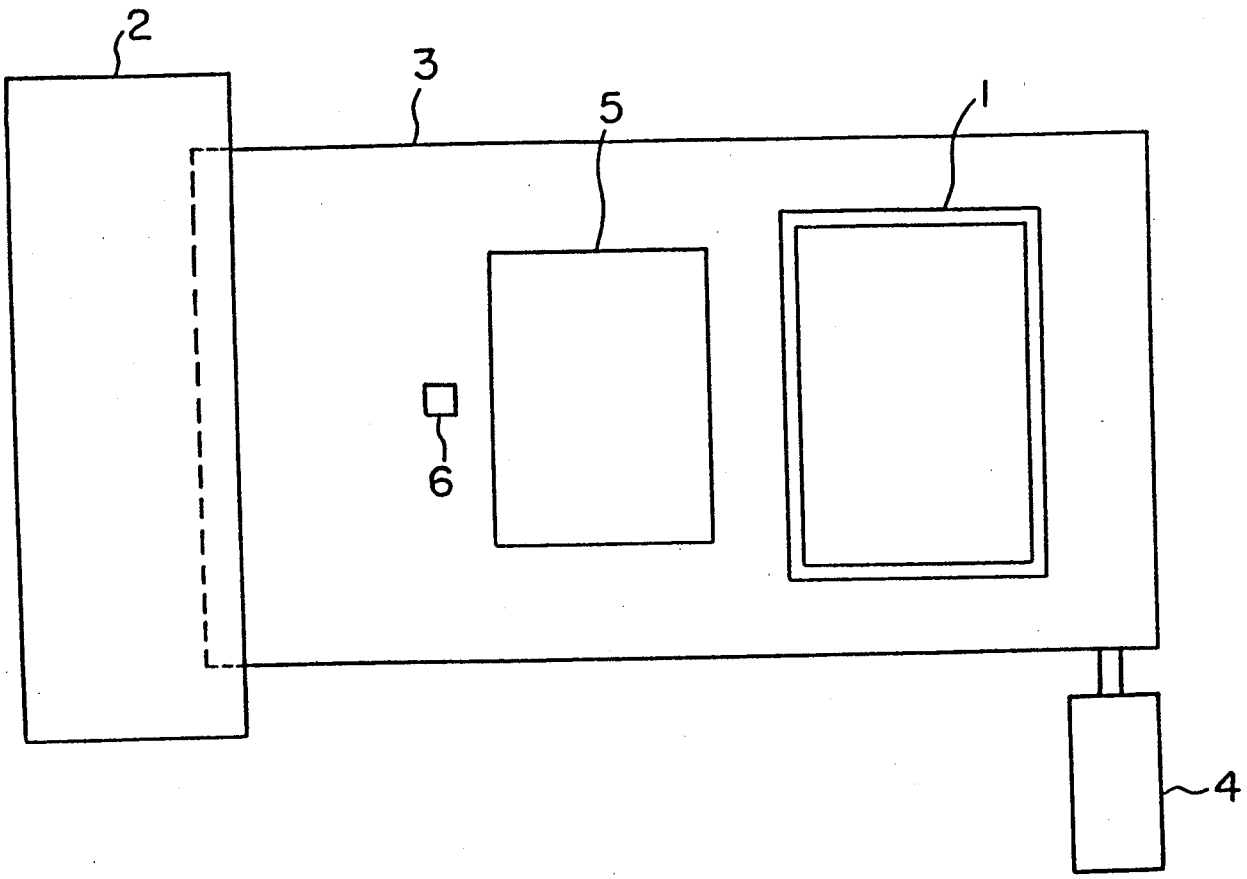
FIG. 2 is a plan view of the embodiment shown in FIG. 1.

FIG. 1 and FIG. 2 are a construction drawing and a plan view, respectively, of an embodiment where a sheet feeding apparatus of the first invention was applied to a flexographic printing press.

This sheet feeding apparatus includes a hopper 1 to pile up corrugated cardboard sheets 5, a suction conveyor 3 extending from a bottom of the hopper to a plate cylinder 2 of a printing press, a servo motor 4 for driving the suction conveyor 3, and a sensor 6 provided to detect front edges of sheets for information of the suction conveyor 3.

A timing belt is used for the suction conveyor 3, and non-slippery material is adhered to surface of the belt. Because the suction conveyor is not a feature of this invention, a usual suction conveyor can be used.

The servo motor 4 for driving the conveyor is controlled by a control unit as shown in FIG. 1, and this control unit comprises a servo amplifier 17 to control speed of the servo motor 4, a pulse tacho-generator (PG) 13 installed at the servo motor 3, a pulse tacho-generator (PG) 12 installed at the plate cylinder 2, an origin sensor 10 to detect origin of the plate cylinder 2, an absolute position counter 18 to detect absolute position of the plate cylinder 2, a subtracter 19, a pulse train generator 20, a position error register 11, a D/A converter 14, an F/V converter 15, and an adder 16.

As shown in FIG. 1, the suction conveyor 3 has a common vacuum gate 7 connected to printer press line shaft (not shown in FIG. 1), and a sheet 5 is taken out from the hopper 1 by up-and-down movement of this gate and is fed to the printing press by the conveyor 3.

The distance L1, in the parallel direction with the conveyor, between a stopper 8 of the hopper 1 and the lower reference point of plate cylinder 2 is set so as to become equal to a circumferential distance of the plate cylinder between front edge of a press plate 9 installed on the plate cylinder 2 and the lower reference point. The sensor 6, to detect front edges of sheets, is positioned at a distance L2 from the lower reference point of plate cylinder 2 in the parallel direction with the conveyor.

In the sheet feeding apparatus having the above-mentioned construction, when the front edge of press plate 9 is located at a position in a distance L1 from the lower reference point of plate cylinder 2, a sheet 5 in the hopper 1 is sucked to the suction conveyor 3 by up-and-down movement of the vacuum gate 7, provided that clearance of stopper 8 is adjusted so as to feed sheets piece by piece. By the above functions, both of the front edge of sheet 5 and the front edge of press plate 9 are located at a position in a distance L1 from the lower reference point of plate cylinder, and thus, approximate phase adjustment is completed.

Then, the sheet 5 is fed to the printing press from the suction conveyor 3. Speed equalization of the servo motor 4 with the plate cylinder 2 and phase adjustment of the sheet 5 to the press plate 9 at feeding the sheet 5 to the printing press are explained below in detail.

At first, the speed equalization of the servo motor 4 with the plate cylinder 2 is described. To the position error register 11, pulses generated by the pulse tacho-generator 12 installed at the plate cylinder 2 are sent as adding input, and pulses generated by the pulse tacho-generator 13 installed at the servo motor 4 are sent as a subtracting input. Then, the deviation of the number of pulses sent from the pulse tacho-generator 13 from the number of pulses sent from the pulse tacho-generator 12 is calculated. This deviation is converted by the D/A converter 14, and then, is provided as voltage output VC. This voltage output expresses the speed difference between the plate cylinder 2 and the servo motor 4, i.e. the speed difference between the plate cylinder 2 and the suction conveyor 3.

In the meantime, the F/V converter 15 converts the pulses from the pulse tacho-generator 12 to voltage signal VA. The voltage signals VC and VA are added together by the adder 16, producing speed command. This speed command is an input to the servo amplifier 17 and controls the speed of servo motor 4, and thus, the speed of suction conveyor 3.

By the above-mentioned procedures, the speed equalization of the servo motor 4 with the plate cylinder 2 is performed. By this way, the speed of suction conveyor 3 follows the speed of plate cylinder 2. But with this speed equalization only, mechanical error caused at suction of a sheet by the suction conveyor 3 remains as error in the phase of sheet 5 from the phase of press plate 9, and produces misalignment of printing. Therefore, it is necessary to correct this phase error.

The correction of the phase error is explained below.

When the sensor 6 detects a front edge of a sheet 5 being transferred by the suction conveyor 3, the absolute position counter 18, which is cleared when the origin sensor 10 detects the origin of plate cylinder 2, is latched and outputs the value A. This value A expresses the absolute position of the front edge of press plate when the front edge of a sheet is detected. The subtracter 19 performs the calculation of $\Delta L = A - L2$. $\Delta L$ expresses the position difference between the front edge of sheet and the front edge of press plate, i.e. the position difference between the sheet 5 and the press plate 9. The error in the position of the sheet 5 from the position of the press plate 9 at feeding the sheet is corrected, having the pulse train generator 20 generate error correction pulses whose number is proportional to $\Delta L$, and inputting the pulses to the position error register 11. For example, in case that the phase of the press plate is ahead of the phase of the sheet, the error correction pulses are sent to the position error register 11 in adding direction in order to advance the phase of sheet, an on the contrary, if the phase of the press plate is behind the phase of the sheet, the error correction pulses are sent to the position error register 11 in subtracting direction in order to delay the phase of sheet. By this way, during the period that the error correction pulses are generated, the speed command voltage sent to the servo amplifier 17 for driving the servo motor is increased or decreased, the speed of servo motor 4 varies in accordance with the speed command voltage, the equalization of the phase of the sheet 5 with the phase of the press plate 9 is performed, and as mentioned above, the servo motor 4 is operated, being equalized with the circumferential speed of the plate cylinder 2.

Because the sheet feeding apparatus of this embodiment corrects the mechanical error caused by the suction of sheets by the suction conveyor as explained above, the sheet feeding accuracy can be improved.

A practice example of the second invention is explained below.

Figure 3:
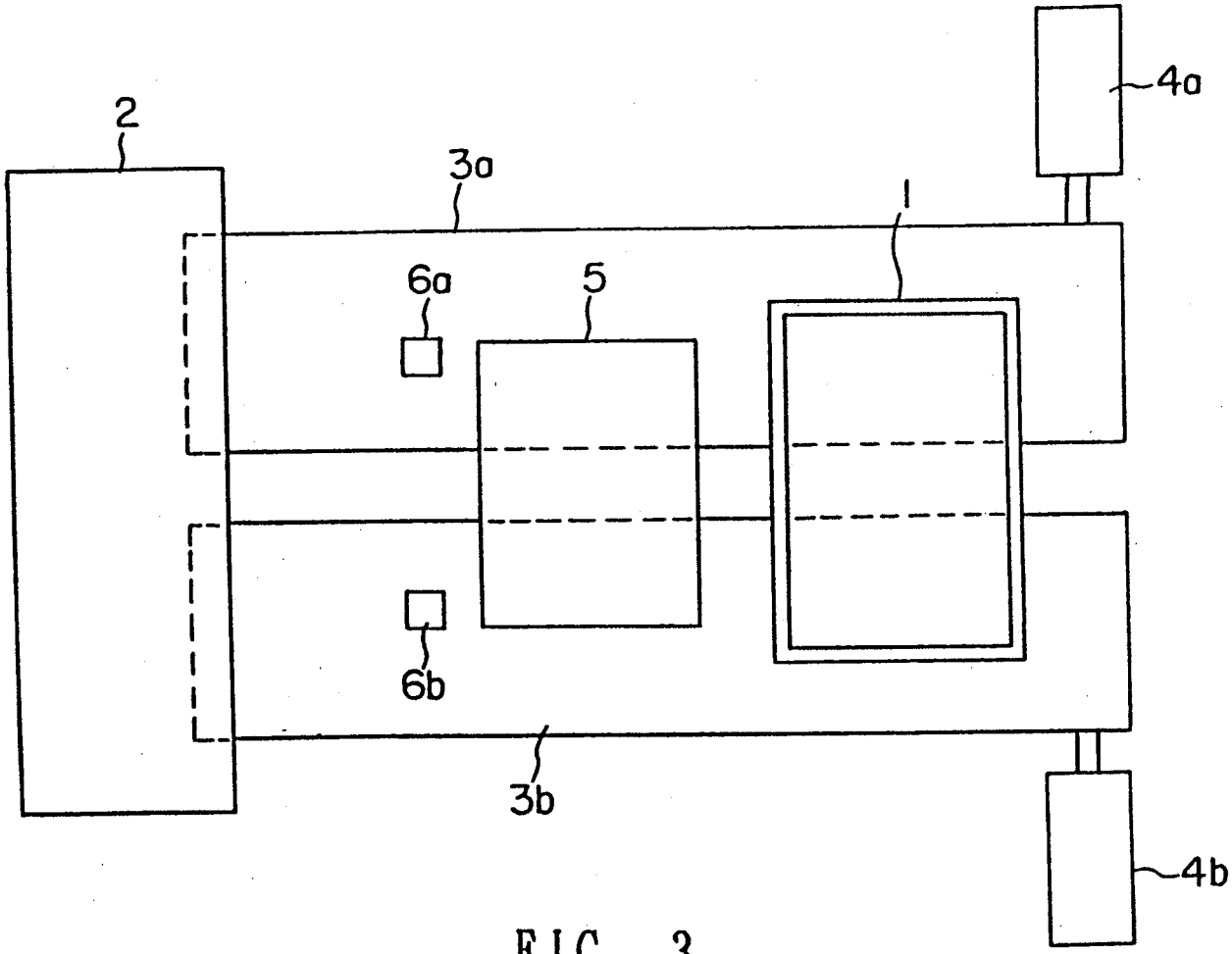
FIG. 3 is a plan view of an embodiment of the second invention.

FIG. 3 is a plan of a sheet feeding apparatus of this embodiment where the sheet feeding apparatus was applied to a flexographic printing press, same as the above-mentioned embodiment. This sheet feeding apparatus includes a hopper 1 to pile up corrugated cardboard sheets 5, two suction conveyors **3*a* and 3*b* extended in parallel from bottom of the hopper to a plate cylinder 2 of a printing press, two servo motors 4*a* and 4*b* for driving the suction conveyors 3*a* and 3*b*, and two sensors positioned above the suction conveyors 3*a* and 3*b*** on straight lines perpendicular to the flow direction of sheets respectively.

Same as the above-mentioned embodiment, timing belts are used for the suction conveyors **3*a* and 3*b***, and non-slippery material is adhered to surfaces of the belts.

Figure 4:
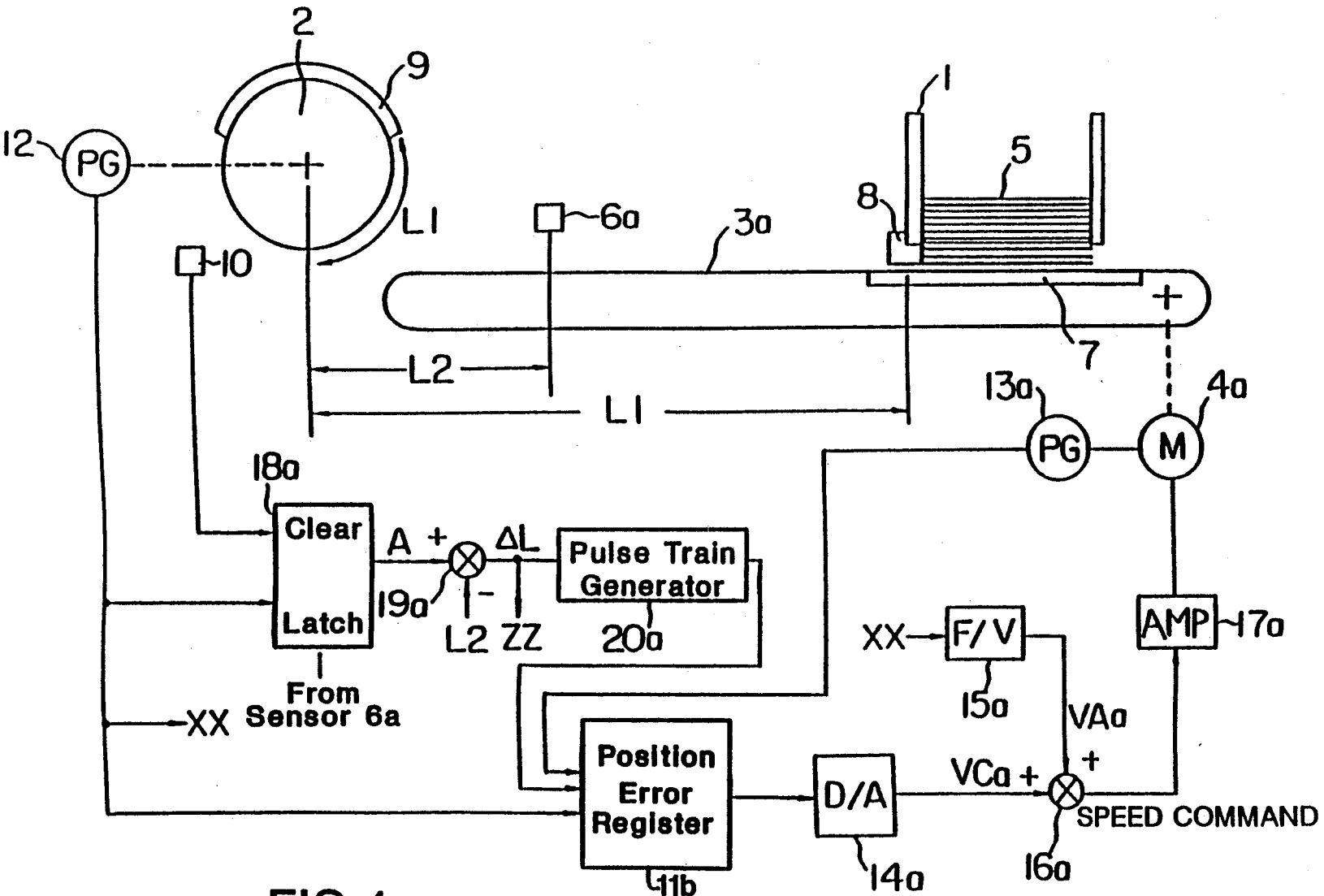
FIG. 4 and FIG. 5 show the construction of the embodiment shown in FIG. 3.
Figure 5:
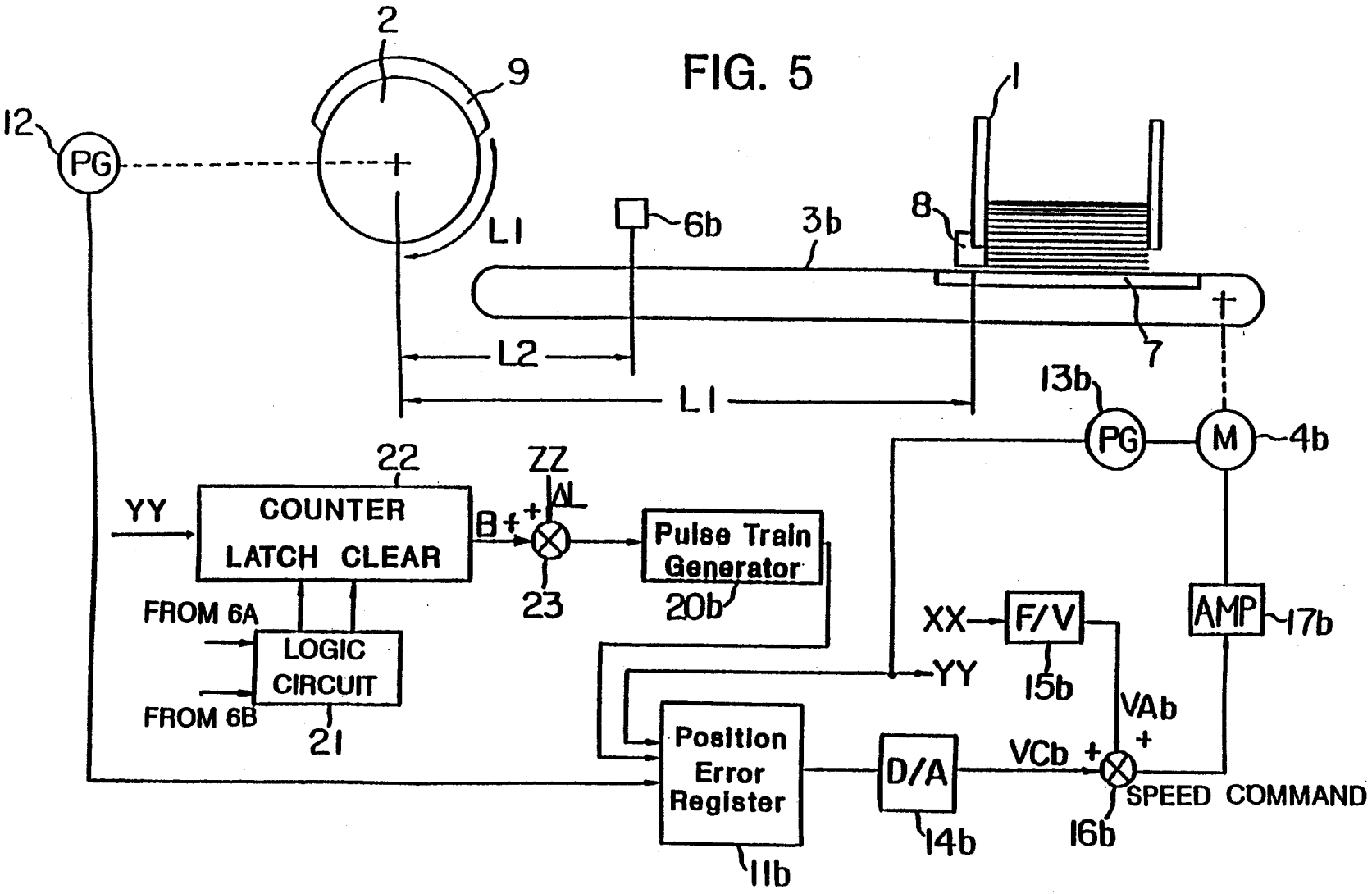

Each of the servo motors **4*a* and 4*b* for driving the conveyors is controlled by a separate control unit. FIG. 4 shows the control unit for the servo motor 4*a* and FIG. 5 shows the control unit for the servo motor 4*b*, together with a side view of the hopper 1, suction conveyors 3*a* and 3*b*, and the plate cylinder 2. When the same components as those for the control unit shown in FIG. 1 are used for the control units shown in FIG. 4 and FIG. 5, the same reference numbers as those shown in FIG. 1 are used in FIG. 4 and FIG. 5. When the components corresponding to those for the control unit shown in FIG. 1 are used for the control units shown in FIG. 4 and FIG. 5, the same reference numbers as those shown in FIG. 1 are used with suffixes of "a" and "b" in FIG. 4 and FIG. 5**.

Namely, the control units shown in FIG. 4 and FIG. 5 have pulse tacho-generators **13*a* and 13*b* corresponding to the pulse tacho-generator 13 shown in FIG. 1, position error registers 11*a* and 11*b* corresponding to the position error register 11 in FIG. 1, D/A converters 14*a* and 14*b* corresponding to the D/A converter 14 in FIG. 1, F/V converters 15*a* and 15*b* corresponding to the F/V converter 15 in FIG. 1, adders 16*a* and 16*b* corresponding to the adder 16 in FIG. 1, servo amplifiers 17*a* and 17*b* corresponding to the servo amplifier 17 in FIG. 1, an absolute position counter 18*a* corresponding to the absolute position counter 18 in FIG. 1, a subtracter 19*a* corresponding to the subtracter 19 in FIG. 1, and pulse train generators 20*a* and 20*b* corresponding to the pulse train generator 20 in FIG. 1. FIG. 5 differs from FIG. 4 in the fact that the control unit shown in FIG. 5 includes a logic circuit 21, a counter 22** and an adder 23. The logic circuit 21 and the counter 22 are performing correction of parallel of sheets.

In the sheet feeding apparatus shown in FIG. 4 and FIG. 5, the suction conveyors 3*a* and 3*b* have a common vacuum gate 7 connected to the printing press line shaft (not shown in the figures), and a sheet 5 is taken out from the hopper 1 by up-and-down movement of this gate and is fed to a printing press by the suction conveyors 3*a* and 3*b*.

The distance L1, in the parallel direction with the conveyors, between a stopper 8 of the hopper and the lower reference point of plate cylinder 2 is set so as to become equal to the circumferential distance between front edge of a press plate 9 installed on the plate cylinder 2 and the lower reference point of plate cylinder. The sensors 6*a* and 6*b* to detect front edges of sheets are positioned at a distance L2 from the lower reference point of plate cylinder 2 in parallel direction with the suction conveyors 3*a* and 3*b*.

In the sheet feeding apparatus having the construction explained above, when the front edge of press plate 9 is located at a position in a distance L1 from the lower reference point of plate cylinder, a sheet 5 in the hopper 1 is sucked to the suction conveyors 3*a* and 3*b* by up-and-down movement of the vacuum gate 7. By the above functions, both of the front edge of sheet 5 and the front edge of press plate 9 are located at a position in a distance L1 from the lower reference point of plate cylinder, and thus, approximate phase adjustment is completed. The sheet 5 is fed to the printing press from the suction conveyors 3*a* and 3*b*. Speed equalization of each of the servo motors 4*a* and 4*b* with the plate cylinder 2, adjustment of the phase of sheets 5 to the phase of press plate 9 and correction of parallel error of the sheet 5 are explained below.

At first, the speed equalization and the phase adjustment are described. The control unit shown in FIG. 4 has the same construction as the control unit shown in FIG. 1, performs the same functions as those of the control unit shown in FIG. 1, and provides speed equalization of the servo motor 4*a* with the press plate 2 and adjustment of the phase of sheet 5 to the phase of press plate 9.

The position error ΔL, which is the output of the subtracter 19*a* of the control unit shown in FIG. 4, is sent to the adder 23 of the control unit shown in FIG. 5. Then, by the functions of the pulse train generator 20*b*, the position error register 11*b*, the D/A converter 14*b*, the F/V converter 15*b* and the adder 16*b*, speed equalization of the servo motor 4*b* with the plate cylinder 2 and adjustment of the phase of sheet 5 to the phase of press plate 9 are performed.

Now, the correction of parallel error of a sheet is explained. Assuming that the sheet 5 being transferred is not in parallel with the plate cylinder 2 but slants against the plate cylinder 2 due to mechanical error caused at suction of the sheet by the suction conveyors, the sensors 6*a* and 6*b* to detect the front edge of the sheet do not generate detection signals simultaneously, but generate the signals with a time interval. These detection signals are sent to the logic circuit 21 of the control unit shown in FIG. 5. The logic circuit 21 generates signal to clear or latch the counter 22 which counts the pulses sent from the pulse tacho-generator 13*b*. Therefore, by detecting advance or delay in phase of the front edge of the sheet by the logic circuit 21 and by counting pulses during this advance or delay by the counter 22, parallel error B of the sheet against the plate cylinder is obtained and is added to the position error ΔL at the adder 23. Thus, correction of the parallel error is performed. Namely, parallel of sheet 5 with the plate cylinder 2 is adjusted by increasing or decreasing speed command voltage and thus, by increasing or decreasing speed of the suction conveyor 3*b*.

Because the sheet feeding apparatus of this embodiment can correct not only the position error of the sheet but also the parallel error of the sheet, using two suction conveyors installed in parallel, as explained above, further improvement of sheet feeding accuracy becomes possible.

Though the embodiment explained above has two suction conveyors, the number of suction conveyors is not limited to two. For example, in case five parallel suction conveyors are used, two each conveyors on the both sides are driven by a separate servo motor.

INDUSTRIAL APPLICABILITY

A sheet feeding apparatus of this invention uses a suction conveyor, and speed equalization and position error correction are applied to servo motor for driving the suction conveyor. Therefore, a sheet feeding apparatus having high sheet feeding accuracy can be provided.

It is also possible to provide a sheet feeding apparatus having extremely high sheet feeding accuracy, by using at least two suction conveyors and by applying speed equalization, position error correction and parallel error correction to servo motors to drive the suction conveyors.

While specific embodiments of the invention have been shown and described in detail to illustrate the application of the principles of the invention, it will be understood that the invention may be embodied otherwise without departing from such principles.

We claim:

1. A sheet feeding apparatus for feeding sheets piled up in a hopper, piece by piece, to a printing press from first and second suction conveyors installed in parallel at a bottom of the hopper, comprising;

a first motor for driving the first suction conveyor, a second motor for driving the second suction conveyor, a first sensor positioned above the first suction conveyor for detecting front edges of sheets being transferred, a second sensor positioned above the second suction conveyor for detecting front edges of sheets being transferred, a first control unit for equalizing speed of the first motor with speed of a plate cylinder of the printing press and for adjusting phase of the sheet to phase of a press plate on the plate cylinder with a detection signal of the first sensor, and a second control unit for equalizing speed of the second motor with speed of the plate cylinder of printing press, for adjusting phase of the sheet to phase of the press plate with the detection signal of the first sensor, and for correcting parallel error of the sheet against the press plate with detection signals of the first and second sensors, whereby sheet feeding accuracy is improved by correction of mechanical error and parallel error at suction of sheets.

2. A sheet feeding apparatus as set forth in claim 1 wherein the first and second control units, each have, means for obtaining speed difference between the plate cylinder and the first and second suction conveyors and for equalizing speed of the first and second motors with speed of the plate cylinder based on the speed difference, and means for obtaining position difference between the sheet and the press plate and for adjusting phase of the sheet to phase of the plate cylinder based on the position difference.

* * * * *